US007469817B2

(12) United States Patent
Brumfield et al.

(10) Patent No.: US 7,469,817 B2
(45) Date of Patent: Dec. 30, 2008

(54) VALIDATING REMOVABLE FARE COLLECTION SYSTEM

(75) Inventors: Jeffrey S. Brumfield, Tullahoma, TN (US); David Lapczynski, Tullahoma, TN (US)

(73) Assignee: Cubic Corporation, San Diego, CA (US)

( * ) Notice: Subject to any disclaimer, the term of this patent is extended or adjusted under 35 U.S.C. 154(b) by 249 days.

(21) Appl. No.: 11/036,203

(22) Filed: Jan. 14, 2005

(65) Prior Publication Data

US 2005/0178639 A1 Aug. 18, 2005

Related U.S. Application Data

(60) Provisional application No. 60/536,821, filed on Jan. 14, 2004.

(51) Int. Cl.
*G07B 15/00* (2006.01)

(52) U.S. Cl. ..... 232/7; 232/12; 232/16; 194/206; 194/350; 235/379

(58) Field of Classification Search ..... 232/7, 232/12, 15, 16, 1 D; 235/10, 378, 379, 384, 235/382; 194/206
See application file for complete search history.

(56) References Cited

U.S. PATENT DOCUMENTS

| | | | | |
|---|---|---|---|---|
| 4,084,677 | A | 4/1978 | Searle et al. | |
| 4,730,117 | A | 3/1988 | Zack | |
| 4,877,179 | A | 10/1989 | Baker et al. | |
| 4,977,502 | A | 12/1990 | Baker et al. | |
| 5,224,579 | A | 7/1993 | Brown | |
| 5,875,879 | A | 3/1999 | Hawthorn | |
| 5,947,330 | A | 9/1999 | Kim | |
| 6,039,164 | A * | 3/2000 | Waters et al. | 194/206 |
| 6,125,988 | A | 10/2000 | Waters | |
| 6,213,277 | B1 | 4/2001 | Blad et al. | |
| 6,398,001 | B1 | 6/2002 | Hutchinson et al. | |
| 6,556,090 | B1 | 4/2003 | Furneaux | |
| 7,191,933 | B2 * | 3/2007 | Miyaji | 235/10 |
| 2002/0063035 | A1 | 5/2002 | Blad et al. | |
| 2003/0230628 | A1 | 12/2003 | Mobley et al. | |

FOREIGN PATENT DOCUMENTS

| | | | |
|---|---|---|---|
| GB | 2223872 | A | 4/1990 |
| WO | WO99/53397 | A | 10/1999 |
| WO | WO99/53398 | A | 10/1999 |
| WO | WO01/69541 | A | 9/2001 |
| WO | WO/03030113 | A | 4/2003 |

* cited by examiner

*Primary Examiner*—William L. Miller
(74) *Attorney, Agent, or Firm*—Townsend & Townsend & Crew LLP

(57) ABSTRACT

A low cost fare collection system includes a removable farebox having an integral collection box. The farebox can be installed in a temporary installation at a fare collection location for the collection of fares and can be removed to a secure location for emptying and reconciliation. The farebox can include an integral collection box for receiving fares deposited in the farebox. The farebox can be configured such that the collected fares can be emptied only when the farebox is removed from the temporary installation to reduce tampering and theft. A fare validator can be used to verify the amount and value of a fare deposited in the farebox to eliminate human validation of fares. Electronic monitors can collect data relating to fares deposited, total revenue collected, time of fare collection, and other data items that can be retrieved when the farebox is removed and emptied.

26 Claims, 11 Drawing Sheets

400

VALIDATING REMOVABLE FARE COLLECTION SYSTEM

CROSS-REFERENCES TO RELATED APPLICATIONS

This application claims the benefit of U.S. Provisional Application No. 60/536,821, filed Jan. 14, 2004, entitled "AUTOMATICALLY VALIDATING REMOVABLE FAREBOX AND COLLECTION SYSTEM," hereby incorporated herein by reference in its entirety.

BACKGROUND OF THE DISCLOSURE

Revenue collection represents an integral part of many service industries. Transportation related services embody a large portion of revenue collection opportunities. For example, transportation services such as trains, buses, taxis, and cars for hire typically collect a fare from passengers that may be a fixed fare or may be determined based on a distance or time. Services such as parking or road access can also be sources of revenue collection, as a fare is typically collected based on access. For example, fees for parking may be collected on the basis of time or may be a fixed rate. Similarly, one or more toll booths positioned along a road can each collect a toll, such that a total fare is determined based in part on the distance traveled.

Because there can be many revenue collection points in any particular system, the designers of revenue collection solutions are continually striving to reduce the cost of collection boxes, while maintaining or increasing validation and reliability. There are typically large numbers of revenue collection points in systems such as parking metering and mass transit.

One typical solution for low cost fare collection in mass transit systems is a visual inspection implementation. In the visual inspection implementation a passenger can insert a fare, such as coins or bills, into a fare collection slot. The coins and bills fall through the slot on to a viewing plate consisting of a secure box having a hinged floor and a clear sidewall for viewing. A transit driver or fare collector visually counts coins by examining the deposited fare through the sidewall. If the fare is correct, the driver can manually operate a lever to dump the fare through the hinged floor into a separate fare collection box. The fare collection box can be removed periodically for emptying and revenue reconciliation.

The visual inspection implementation can be very low cost because it can omit all electronics and automated mechanical devices. Unfortunately, the lack of sophistication of the visual inspection implementation is a source of disadvantages. Reliance on the driver for visual inspection of the fare results in a high error rate. Additionally, the system throughput is limited by the driver's ability to determine that the correct fare is deposited in the receiver.

The visual inspection implementation typically lacks sufficient sophistication to minimize loss of revenue. The visual inspection implementation typically lacks the substantial electronics that enable gathering of data useful for revenue verification and auditing. Additionally, the fare collection box is typically removed from the remainder of the fare collection system and the contents emptied into a common collection bin. Because the revenue is typically aggregated before reconciliation, it is not possible to create an audit trail that leads back to the individual fare collection points. Furthermore, without electronic monitoring of collected fares, it is unlikely that an accurate accounting of the expected revenue collected within a collection box can be maintained. The inability to audit revenue collection to the point of transaction creates the potential for fraud or embezzlement.

BRIEF SUMMARY OF THE DISCLOSURE

A system and method for providing a validating, removable, farebox and collection system is disclosed. The validating removable farebox can be adapted for mobile uses, such as in the cabin of a bus, and stationary uses such as parking meters to provide convenient access to both patrons and an operator. The removable farebox can include a validator with mechanisms and circuitry for accepting, validation and counting of each patron payment. In one embodiment, the validator can automatically identify and validate payments submitted, count the payments, store a running tally and based on this information, and present information on the patron display. If the cash collected meets the expected fare, the removable farebox can indicate a paid fare and can clear the running tally. Accordingly, the operator is freed from validating payment and confirming the registered value is the proper amount.

The validating removable farebox can also include mechanisms to store the payments in a secured section of the device. The entire farebox can be removable for periodic emptying, data extraction, and programming of the expected fare. A secure farebox and data collection cart can form a portion of an auditable collection system.

In one aspect, the disclosure includes an apparatus for revenue collection. The apparatus includes a housing configured to be installed in a revenue collection point for revenue collection and removed from the revenue collection point for revenue extraction, a validator mechanically coupled to the housing and configured to validate a received payment, and a collection receptacle integral to the housing and configured to collect the received payment.

In another aspect, the disclosure includes an apparatus for revenue collection, where the apparatus includes a housing configured to be installed in a revenue collection point for revenue collection and removed from the revenue collection point for revenue extraction; a validator mechanically coupled to the housing and configured to validate a received payment, a collection receptacle integral to the housing and configured to collect the received payment, a secure access coupled to the housing and configured to provide access to contents of the collection receptacle only when the housing is removed from the revenue collection point, a farebox controller coupled to the validator and configured to generate an output based on an output from the validator and further configured to compile one or more data based on the output from the validator, and a data port coupled to the farebox controller and having one or more storage devices configured to receive the one or more data from the farebox controller for subsequent extraction.

In yet another aspect, the disclosure includes an apparatus for revenue collection, where the apparatus includes means for releasably securing the apparatus to a revenue collection point, means for validating received revenue coupled to the means for releasably securing the apparatus, means for providing an output based on an output from the means for validating, and means for collecting revenue received from the means for validating coupled to the means for releasably securing.

In another aspect, the disclosure includes an apparatus for transport of removable fareboxes, where the apparatus includes one or more receptacles, each configured to receive one removable farebox, a farebox identification module configured to determine an identification for each removable farebox inserted into the one or more receptacles, and further configured to determine if each farebox contains revenue, and a locking mechanism configured to lock those removable fareboxes inserted into the one or more receptacles determined to contain revenue.

In another aspect, the disclosure includes a method of secure revenue collection. The method includes initializing a fare tally, receiving a payment in a removable farebox having an integral revenue collection receptacle, validating the payment, collecting the payment in the integral revenue collection receptacle, displaying an output based at least in part on the payment, determining if a sufficient fare has been received, and emitting an audio output if the sufficient fare has been received.

In another aspect, the disclosure includes a method of secure revenue collection, where the method includes initializing a removable farebox, installing the removable farebox in a revenue collection point, collecting revenue using the removable farebox, removing the removable farebox from the revenue collection point, transporting the removable farebox to a revenue collection location, extracting revenue from the removable farebox, and extracting fare data from the removable farebox.

BRIEF DESCRIPTION OF THE DRAWINGS

The features, objects, and advantages of embodiments of the disclosure will become more apparent from the detailed description set forth below when taken in conjunction with the drawings, in which like elements bear like reference numerals.

DETAILED DESCRIPTION OF THE DISCLOSURE

Figure 1:
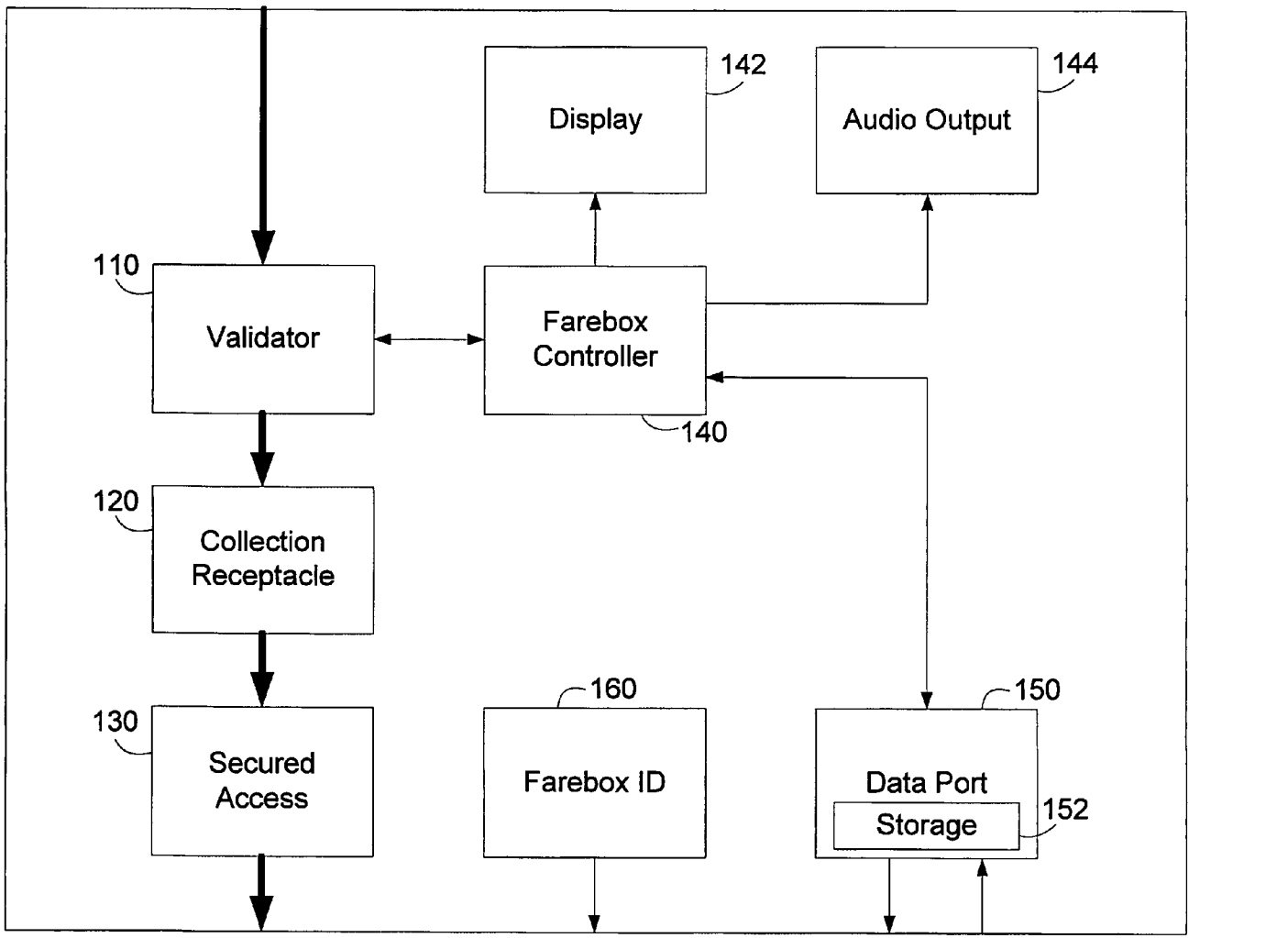
FIG. 1 is a functional block diagram of an embodiment of a validating removable farebox.

A low cost removable validating farebox with extremely high reliability is disclosed. In one embodiment the removable farebox can automate coin collection within a fare collection system. The removable farebox can be configured to be installed and removed from a revenue collection point with minimal time and minimal or no tools.

The removable farebox can be configured to receive coins or tokens inserted into a coin collection slot. The coins can be configured to fall through the slot and be directed to a coin validator. The validator can be configured to validate the value of the coin or token and count the received fare. The received coins can be directed to a secured section of the removable farebox where all received fares are collected.

The validator can be configured to automatically identify real vs. fake coins, count coins, store a running tally, and present the running tally on a patron display. If the collected fare meets the expected fare, the removable farebox can be configured to emit an audible beep or otherwise indicate receipt of a paid fare. The validator can clear the running tally in anticipation of the next patron. The removable farebox can capture and update data stored for future extraction or auditing.

The removable farebox can be configured to be mounted on a secure base when configured for fare collection. The entire removable farebox can be removed for emptying, data extraction, and programming of the expected fare.

The validating removable farebox can be implemented for a low cost relative to similarly featured revenue collection systems. The removable farebox can be configured to eliminate a separate cash box, require only simple processing, omit moving parts, and have minimal component counts.

The removable farebox can use a validator to validate and count received fares such that driver verification can be eliminated. Eliminating driver input from the validation process results in a low error rate. Automatic validation and counting can result in accuracy of coin validation that is typically greater than 99.5%. Furthermore, electronic validation can be implemented with no moving parts. The elimination of moving parts can result in a highly reliable farebox that typically has low current consumption due to the lack of mechanical actuators.

Electronic validation also can be configured to provide feedback to the patron. the removable farebox can be configured with a patron display that shows a deposited coin value and a cumulative deposited value. Another driver display can be configured to show the same information to a driver. Additionally, or alternatively, the removable farebox can be configured to emit an audible beep or otherwise indicate when a full fare is paid.

The removable farebox can be configured to collect data during fare validation. For example, as each coin is received, the removable farebox can count it and maintain a record of accumulated fares for later cash reconciliation and audit. The stored data can be extracted, for example, at a money counting facility.

The removable farebox can route the received fares to a sealed collection box. The combination of the sealed collection box and data collection for automatic auditing are protection from fraud/embezzlement. In one embodiment, the removable farebox can route coins to a collection box positioned in the bottom of the farebox. The collection boxes can be integrated within the removable farebox and incapable of separate removal from the farebox. In such a configuration, changing an overall length of the removable farebox can vary coin capacity. The removable farebox can be manufactured to be narrow and significantly smaller than a typical farebox.

The removable farebox can be removed in its entirety and replaced with another removable farebox for purposes of cash and data extraction. The removable farebox can be taken to a secure location for cash extraction to minimize tampering and theft of revenue. Fare collection can thus be audited back to the point of fare origination.

In another embodiment, the removable farebox can be fitted with a coin return cup to route invalid or excess coins back to the patron for refund. In yet another embodiment, the removable farebox can be fitted with a coin singulator to allow the patron to simultaneously insert multiple coins. The coin singulator can be configured as an electro-mechanical device that takes groups of coins, separates them, and presents a single coin at a time to the coin validator. The coin singulator can improve the coin processing time because the patron is not forced to enter a single coin at a time. The fare in coins is simply dropped into a large opening and the coin singulator separates the coins. Examples of other embodiments and variations are provided in the detailed description provided below.

FIG. 1 is a functional block diagram of an embodiment of a removable farebox 100. The removable farebox 100 embodiment of FIG. 1 represents a low cost implementation having the ability to receive and validate coins, which may include tokens. The removable farebox 100 can be configured to omit the ability to accept paper such as tickets or paper currency in order to eliminate all motorized mechanical parts from the removable farebox 100. The removable farebox 100 embodiment of FIG. 1 can be implemented, for example, without any movable mechanical parts within the coin validation and collection portions of the removable farebox 100. The elimination of movable parts can substantially decrease or eliminate cost and reliability issues associated with part wear.

The removable farebox 100 can include a validator 110 configured to accept the coins deposited by a patron. In the functional block diagram of FIG. 1, the path shown in bold can represent the path of physical revenue accepted by the removable farebox 100, such as coins and tokens. The thin lines connecting functional blocks can represent signal flow and interconnections. The validator 110 can route the coins to a collection receptacle 120, which may be alternatively referred to as a coin receptacle or collection box. The contents of the collection receptacle 120 can be accessed via a secured access 130.

In one embodiment, the collection receptacle 120 can be integral to the removable farebox 100, such that there is not a separately removable collection box within the removable farebox 100. Access to the contents of the collection receptacle 120 can be limited to access through the secured access 130, and typically, the collection receptacle 120 is only accessed to empty the contents of the collection receptacle 120.

The secured access 130 can be positioned such that access is denied or otherwise substantially limited when the removable farebox 100 is positioned in a mounting base for collection of fares. For example, the secured access 130 can be a lockable access door that can be positioned on a lower face of the removable farebox 100 that is substantially occluded by a mounting base that the removable farebox 100 mates with when positioned for fare collection. In such an embodiment, the secure access 130 cannot typically be accessed or operated when the removable farebox 100 is positioned to collect fares. The contents of the collection receptacle 120 are typically emptied through the secured access 130 when the removable farebox 100 is removed and transported to a secure location.

The validator 110 can be configured to determine a value associated with each coin that is received by the removable farebox 100. The validator 110 can be, for example, an electronic coin validator, such as those described in U.S. Pat. No. 6,398,001 to Hutchinson, et al., entitled "Coin Validator", or U.S. Pat. No. 6,556,090 to Furneaux, entitled "Oscillator Circuit for a Validator" or an electromechanical coin validator such as those described in U.S. Pat. No. 4,084,677 to Searle, et al., entitled "Coin Validator Modification," each of which is hereby incorporated herein by reference.

The validator 110 can communicate one or more signals indicating the value of received coins to a farebox controller 140. The farebox controller 140 can be configured to generate and communicate one or more outputs based on the coin value to one or more output devices. For example, the farebox controller 140 can receive the value of the coin from the validator 140 and generate a visual output that can be communicated to one or more displays 142. The one or more displays 142 can include an LED display, an LCD display, a CRT display, and the like or some other device for providing visual output.

The one or more displays 142 can include a patron display that is positioned to be viewable from a typical patron vantage point, where, in the context of operation of the removable farebox 100, the patron is the individual providing the coins to the removable farebox 100. The one or more displays 142 can also include an operator display that is configured to be viewable from an operator vantage point, where the operator can be, for example, a driver of a transit bus.

The farebox controller 140 can be configured to generate display output that corresponds to the value of the most recently received coin, a running tally of coins received since the last full fare was received, a value remaining to be received for a full fare, or some other indication or combination of indications. The display output can be displayed on the one or more displays 142.

The farebox controller 140 can also be configured to generate one or more output signals that can be communicated to an audio output device 144. The audio output device 144 can generate an audio output based in part on the signals received from the farebox controller 140. The audio output device 144 can be, for example, a speaker, buzzer, piezoelectric device, whistle, and the like, or some other device for providing audio output. In one embodiment, the farebox controller 140 can configure the audio output device 144 to emit an audible beep in response to receipt of a valid coin. In another embodiment, the farebox controller 140 can configure the audio output device 144 to emit an audible tone that is based on the value of the received coin.

The farebox controller 140 can also be configured to retrieve a expected fare value from a data port 150, which may include one or more storage devices configured to store the preprogrammed expected fare value. The farebox controller 140 can compare the expected fare value to the running tally of received coins. If the value of the running tally equals or exceeds the expected fare value, the patron has inserted sufficient coins to pay for the fare. The farebox controller 140 can configure an output that is displayed on the one or more displays 142 indicating receipt of a fare. The farebox controller 140 can also configure the audio output device 144 to emit an audible tone or beep indicating receipt of the fare.

Typically, when the removable farebox 100 indicates receipt of the full fare value, the patron is provided access, such as when the driver acknowledges that the patron is granted access to a transit bus. Upon receipt of the expected fare, the farebox controller 140 can reset any running tally counter in preparation of receiving a fare from the next patron. The farebox controller 140 can be configured to automatically reset the running tally counter, or can be configured to reset the running tally counter in response to input received from an operator.

The farebox controller 140 can also be configured to collect data associated with the received fares and update and store the data in one or more storage devices 152 within the data port 150. The farebox controller 140 can be configured, for example to monitor and store a count of the different types of coins received by the removable farebox 100, and may determine and store a running total of the revenue received by the removable farebox 100. In some embodiments, the farebox controller 140 may include a clock or timer, or interface with a clock or timer (not shown), such that the time associated with the receipt of fares can also be stored in the storage devices 152 of the data port 150. The farebox controller 140 can thus track the amount of revenue collected, the number of each denomination of coins collected, and the time that each of the coins or fares was collected. The data can be downloaded at the time that the revenue is emptied from the collection receptacle 120. The data counters can then be reset prior to the removable farebox 100 being returned to service.

The removable farebox 100 can also include a farebox identification 160 that is typically some type of machine readable identification. The farebox identification 160 can be, for example, a serial number or identification stored electronically in a memory and accessible through a wired interconnect. Alternatively, the farebox identification 160 can be stored in electronic format, such as in an RF tag, that is accessible through a wireless link. In other embodiments, the farebox identification 160 can include an optically readable bar code, an optically readable pattern, a machine readable configuration of physical bumps or features, and the like, or some combination of such machine readable identifications, or some other feature for machine readable identification.

In a typical application, the removable farebox 100 can be configured in a secure revenue collection location, where the contents of the collection receptacle 120 are emptied and the data port 150 storage devices are reset to indicate an empty collection receptacle 120. If desired, the expected fare can be programmed to the removable farebox 100. A date and time of any clock and calendar within the removable farebox 100 can also be programmed.

The empty and initialized removable farebox 100 can be positioned in a fare collection point, such as in a transit bus. The removable farebox 100 can replace another removable farebox 100 that is being removed from service, for example, for emptying and reconciliation. The removable farebox 100 that is placed in service can then operate to receive fares and track the receipt of fares until the next service period.

The removable farebox 100 can then be removed from service and transported to the secure revenue collection location where the identity of the removable farebox 100 is tracked and the contents of the collection receptacle 120 are emptied via the secure access 130. The compiled data in the data port 150 can be downloaded using, for example, a wired or wireless link. The downloaded data can then be compared against the revenue collected from the collection receptacle 120. Any discrepancy can be traceable to a particular revenue collection point at a particular time period.

The data can also be useful for management of the overall system. For example, if the number of fares collected by a transit bus during a particular time frame is consistently high, the number of patrons may justify an increase in the number of vehicles servicing a route corresponding to the period of increased ridership. Additionally, the times corresponding to the collection of fares can provide an accurate indication of the travel times associated with a particular service route.

Figure 2:
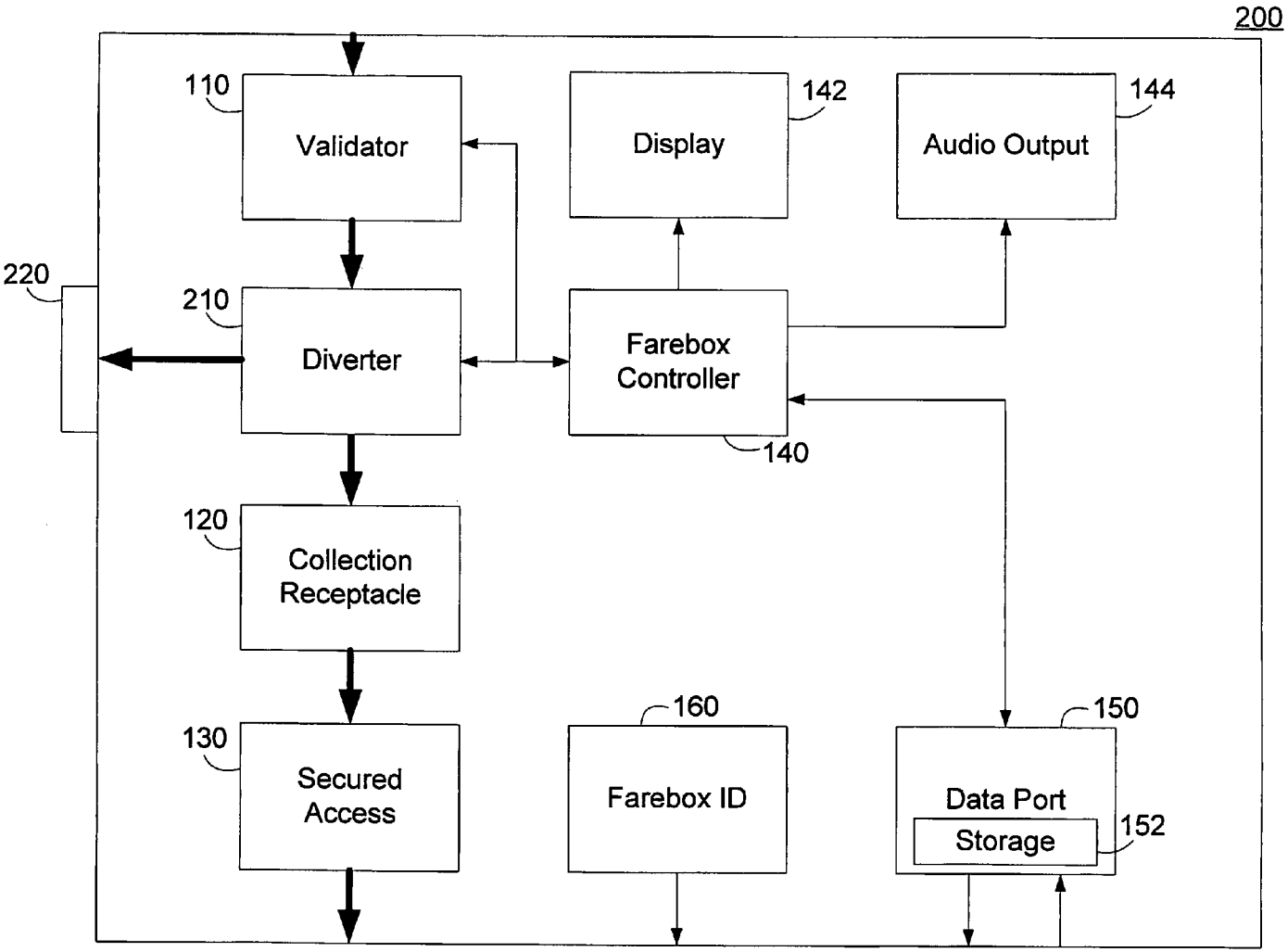
FIG. 2 is a functional block diagram of an embodiment of a validating removable farebox having coin return.

FIG. 2 is a functional block diagram of another embodiment of a removable farebox 200. The configuration of the removable farebox 200 of FIG. 2 is similar to the configuration shown in FIG. 1, except that a coin diverter 210 and coin return 220 are included in the removable farebox 200. The remaining portions of the removable farebox 200.

The coin diverter 210 can be positioned interposed between the coin validator 110 and the collection receptacle 120. The coin diverter 210 can be configured to selectively route a received coin to the collection receptacle 120 or to a coin return 220 that can be accessible to the patron. The coin diverter 210 can determine the desired coin destination based on an input received from the coin validator 110. Typically, the coin diverter 210 is implemented as an electromechanical device. For example, the coin diverter 210 can include an arm, track, or tab that directs the received coin to the desired path based on the input from the coin validator 110. Thus, inclusion of the coin diverter 210 may introduce movable mechanical elements to a device that would otherwise have no moving parts.

The coin validator 110 can provide a valid coin signal that indicates whether the received coin is a valid coin or token. For example, the coin validator 110 may provide a valid coin signal that indicates a valid coin when it determines that a genuine denomination coin or token is received by the removable farebox 200. The coin validator 110 can also provide an invalid coin signal that indicates that an invalid coin or token is received by the removable farebox 200. In an optional embodiment, the coin validator 110 can be configured to provide the invalid coin signal for any coins received in excess of a predetermined fare. This enables any overpayment to be returned to the patron. Alternatively, the validator 110 may have no knowledge of a predetermined fare and thus may not have the ability to determine an overpayment. In such an embodiment, excess coins are collected in the revenue collection receptacle 120 and may be credited to the next fare.

The coin diverter 210 can route the received coin to the collection receptacle 120 if the valid coin signal is received. Conversely, the coin diverter 210 can route the received coin to the coin return 220 if the invalid coin signal is received from the coin validator 110.

Figure 3:
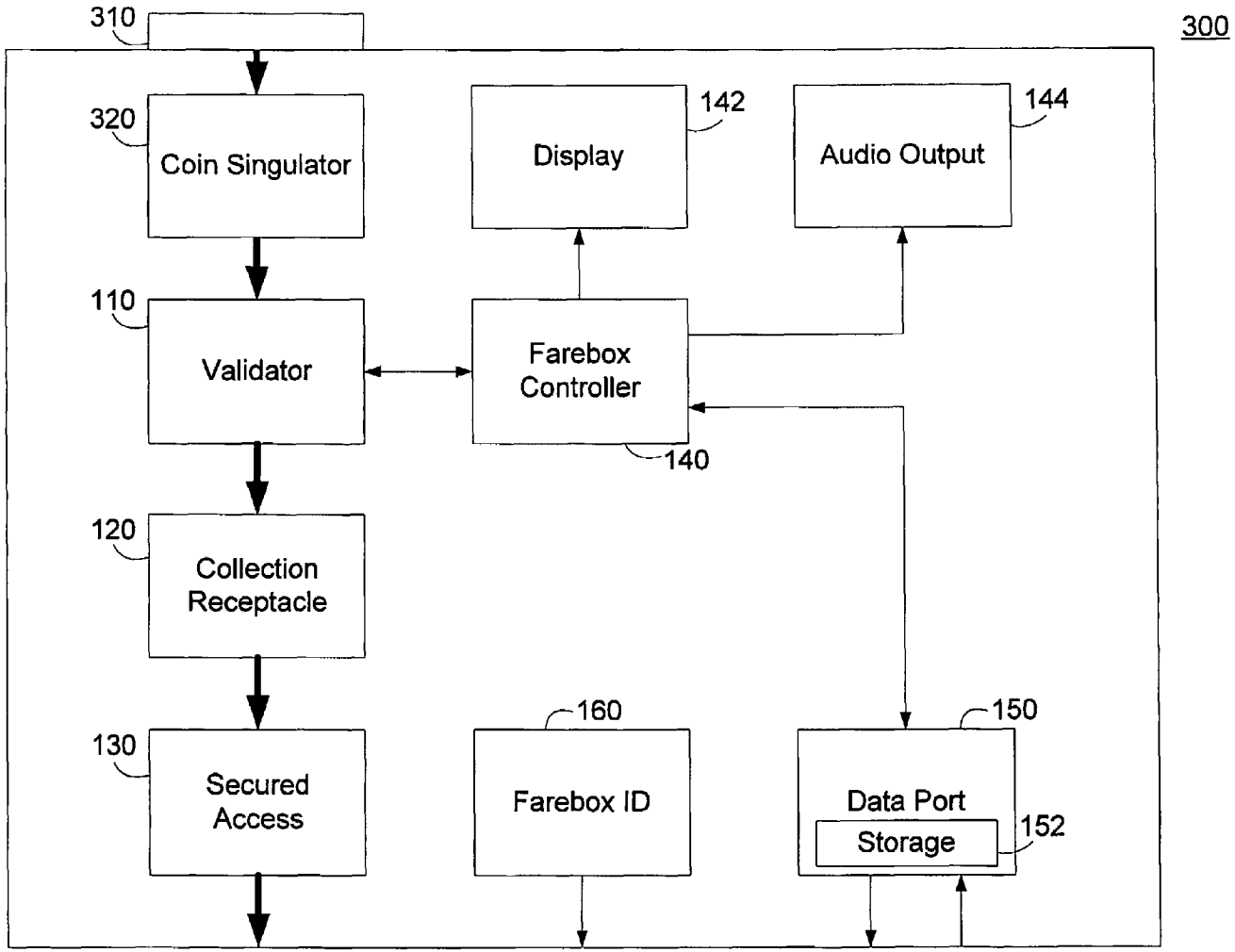
FIG. 3 is a functional block diagram of an embodiment of a validating removable farebox having a coin singulator.

FIG. 3 is a functional block diagram of another embodiment of a removable farebox 300. The removable farebox 300 of FIG. 3 is similar to the one shown in FIG. 1, except that the removable farebox 300 includes a fare receiver 310 coupled to a coin singulator 320.

The removable farebox 300 can include a fare receiver 310 that can be configured to direct one or more received coins or tokens to a coin singulator 320. The fare receiver 310 can be configured, for example, as a concave receptacle having a relatively large opening for receiving coins and tokens. The fare receiver 310 can, for example, funnel the coins to the coin singulator 320.

The removable farebox 300 can be fitted with the coin singulator 320 to allow the patron to simultaneously insert multiple coins. The coin singulator 320 can be configured as an electro-mechanical device that takes groups of coins, separates them, and presents a single coin at a time to the coin validator 110. Examples of a coin singulator 320 include those disclosed in U.S. Pat. No. 4,877,179 to Baker, et al., entitled "Farebox Security Device" issued Oct. 31, 1989, and hereby incorporated herein by reference.

The coin singulator 320 can improve the coin processing time because the patron is not required to enter a single coin at a time. The fare in coins can be dropped into a large opening of the fare receiver 310 and the coin singulator 320 can separate the coins for validation by the coin validator 110.

The remainder of the removable farebox 300 can be the same as that described in relation to FIG. 1. Other removable farebox embodiments can include both the coin diverter shown in FIG. 2 as well as the coin singulator shown in FIG. 3.

Although the embodiments shown in FIGS. 1-3 detail the receipt and validation of coins or tokens, in other embodiments the validator can be a fare validator implemented in one or more modules that can be configured to validate coins or tokens, notes, tickets, electronic cards or passes, or some combination thereof. Thus, the validator of the embodiment of FIG. 1 can be configured to validate coins as well as electronic payments without introducing any moving parts to the removable farebox. For example, the validator can include a slot for card swipes or can include an RF transceiver configured to wirelessly validate electronic payment.

Figure 4A:
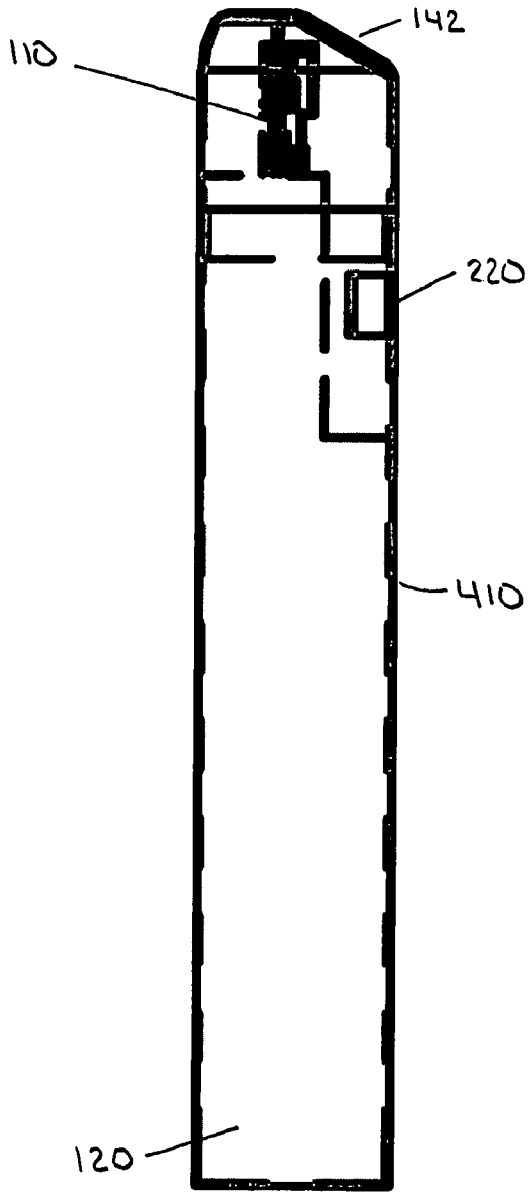
FIGS. 4A-4C are embodiments of a removable farebox.

FIG. 4A is an embodiment of a removable farebox 400 configured as substantially cylindrical in shape. The removable farebox 400 includes a housing 410 that can be of substantially cylindrical shape. The substantial cylindrical shape of the housing 410 can lower the overall cost of the removable farebox 400, because the housing may be formed from an extrusion. Additionally, the cylindrical housing 410 can contribute to physical strength of the removable farebox 400, as corners and edges can be substantially eliminated from the outline.

The removable farebox 400 can include a validator 110 and output display 142 positioned on an upper portion of the housing 410. Additionally, a coin return 210 can be integrated into a side of the housing to allow for return of invalid or excess coins. A substantially hollowed portion of the housing 410 can be used as the integral collection receptacle 120. Thus, the size of the collection receptacle 120 can be varied by varying the height and outside dimension of the housing 410.

Previous farebox designs are typically limited in the different heights due to constraints minimizing the height of the farebox so that operators can see over the device to validate the fare submitted by a patron. The height of the removable farebox 400 is not constrained as in the past because the validator 110 can operate to automatically validate the received fare without the need for visual inspection by the operator. The entire removable farebox 400 is typically secured at its base to a mounting plate, as will be discussed in further detail in subsequent figures.

Figure 4B:
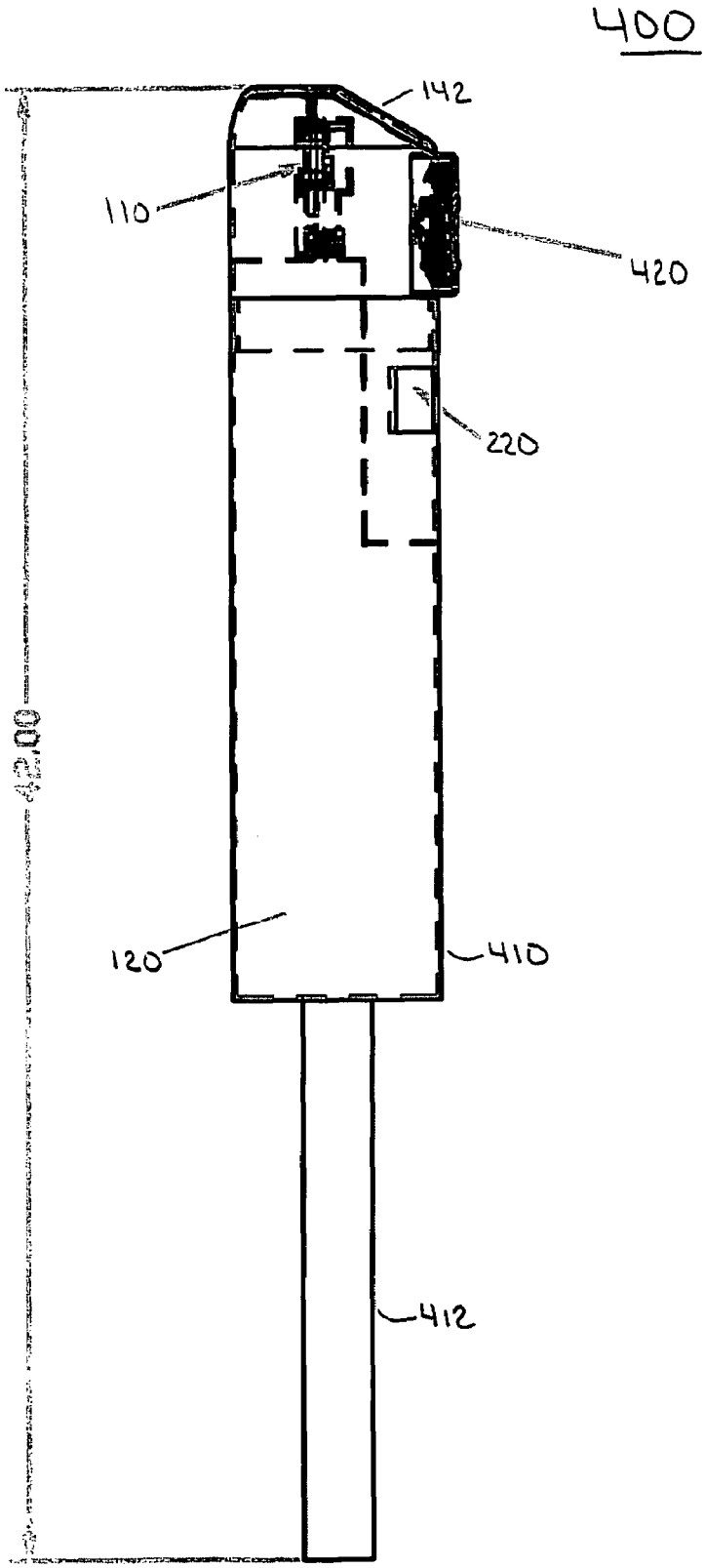

FIG. 4B is another embodiment of a removable farebox 400. The removable farebox can include a housing 410 that is mechanically coupled to a support post 412. The support post 412 can form part of the removable farebox 400 or can be part of the mounting base. The housing 410 can be made to be shorter than the housing for the removable farebox of FIG. 4A, for example, to minimize the size of the collection receptacle 120. The height of the support post 412 can be varied to vary the height of the removable farebox 400.

The housing 410 can support the validator 110, display 142, and coin return 220 as was the case with the embodiment of FIG. 4A. Additionally, the housing can support an electronic fare module 420 that can be part of the validator 110. The electronic fare module 420 can be configured to accept fares that are presented by electronic cards or tags, which can include magnetic media, smart cards, RF tags, and other types of electronic media.

Figure 4C:
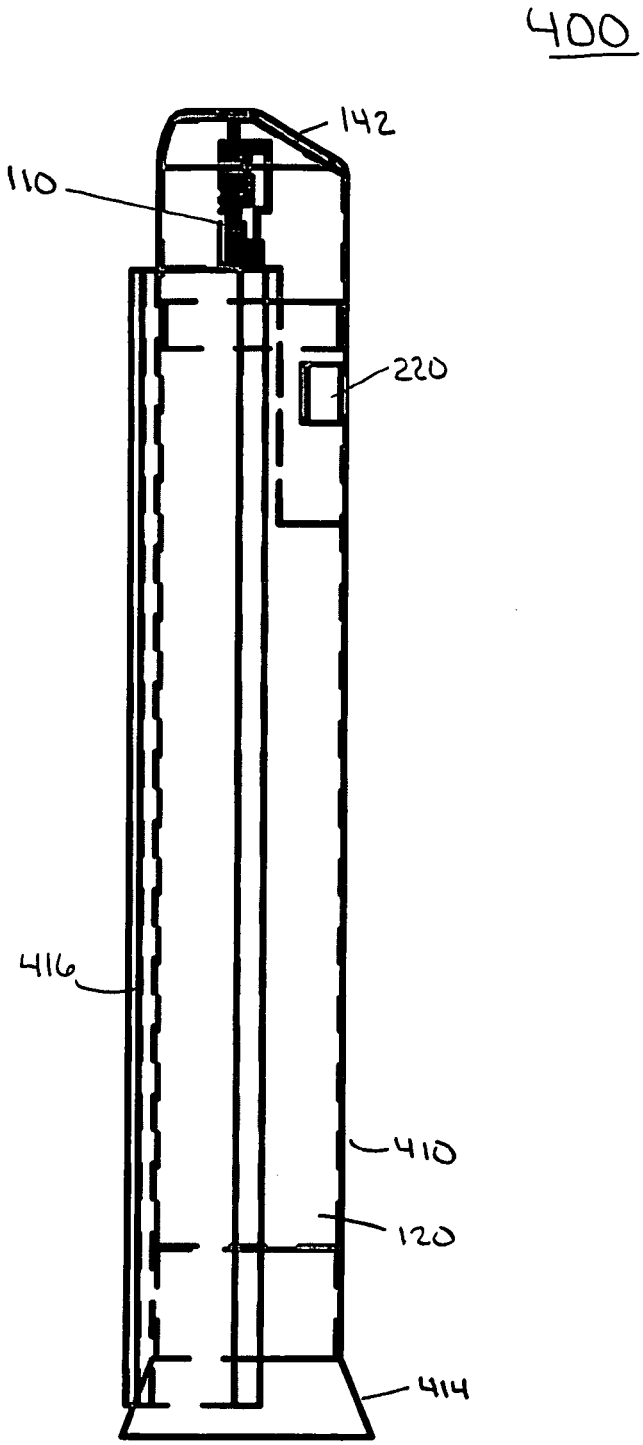

FIG. 4C is another embodiment of a removable farebox 400. The removable farebox 400 is similar to the one shown in FIG. 4A except the removable farebox 400 of FIG. 4C can include a housing 410 that is mechanically coupled to a flanged base 414. The flanged base 414 can be used, for example, to further limit access to the mounting base interface that will be discussed in further detail in subsequent figures. The housing 410 can also have a support plate 4165 that can wrap around a portion of the housing 410 and can provide additional mechanical support as well as increased security against attempted intrusions into the collection receptacle 120. The remainder of the removable farebox 400 can be the same as that shown in FIG. 4A.

As can be seen from the embodiments of FIGS. 4A-4C, the removable farebox 400 can be constructed in a modular fashion. The coin return 220 and associated diverter can be positioned in a portion of the housing or omitted by filling the portion of the housing with a blank plate. Similarly, the validator and singulator can be configured by varying a top portion of the removable farebox. For example, the same housing 410 may be configured with different combinations of validator, singulator, diverter, and electronic fare module to generate any of the embodiments of FIGS. 4A-4C, or some other embodiment.

Although the removable farebox is described as being removed for revenue collection, other embodiments may be configured to be more similar to legacy fare collection systems or configured to modify legacy revenue collection systems.

For example, an Interface Driver Control Unit (DCU) for advanced fare processing can be used where an automatically validating coin farebox becomes a revenue sensor for a fare processor engine in the DCU. The farebox can include an adapter kit including a coin validator, mounting housing, and patron and driver displays. As coins pass through the coin validator, the coin is validated and counted and the value displayed on the patron and driver displays.

In a particular system embodiment, the Interface DCU can be coupled to a removable farebox, such as one described in FIGS. 1-3. The removable farebox can communicate to one or more intelligent device, such as the DCU, while installed at the revenue collection point, and thus, the removable farebox can operate as an integrated peripheral. The removable farebox can report its identity, the coins or other revenue accepted, and can display messages or other output and create audio alerts as commanded by the DCU.

In another embodiment, the Interface DCU to coin validator can provide full revenue data collection. Existing farebox systems can be upgraded to state of the art revenue collection equipment. However, cash extraction and vaulting remains unchanged from legacy system.

Figures 5A, 5B:
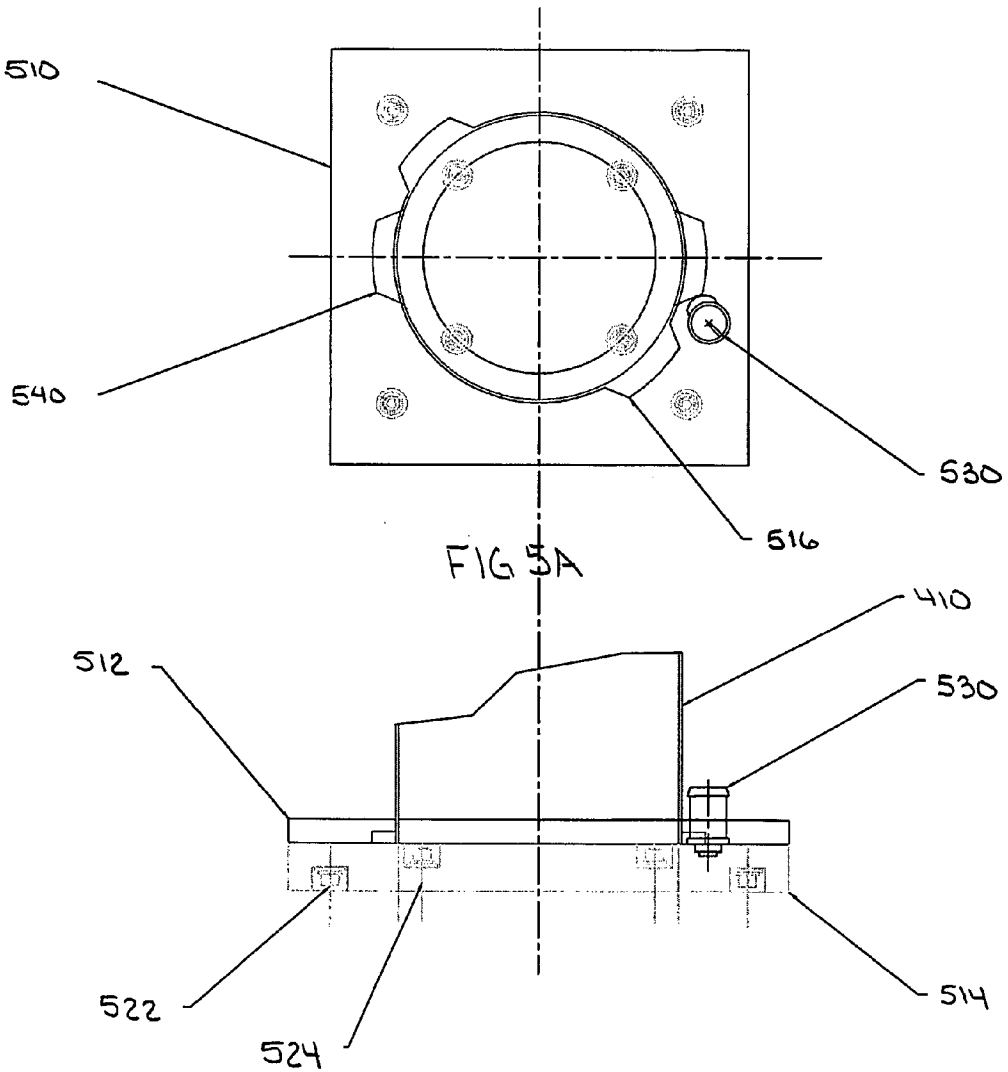
FIGS. 5A-5B are views of an embodiment of a pedestal for a removable farebox.

FIGS. 5A-5B are views of an embodiment of a pedestal for a removable farebox. The embodiment of the pedestal can be used, for example, to secure a removable farebox in a fare collection point, which can be on a transit bus.

FIG. 5A is a bottom view of a removable farebox inserted into a mounting base 510. The mounting base 510 can include an opening having one or more recesses 516 or slots configured to receive the base of the removable farebox and one or more tangs 540 positioned to extend from substantially the lower end of the removable farebox. As shown in FIG. 5A, the lower portion of the removable farebox can be inserted into the opening in the mounting base 510 when the tangs 540 substantially align with corresponding recess 516. In one embodiment, the number and position of the tangs 540 and recesses 516 can be configured to limit the orientation of the removable farebox. In other embodiments, the orientation of the removable farebox may be adjusted by an installing technician.

The removable farebox can be captured or otherwise secured to the mounting base 510 by rotating the removable farebox such that the tangs 540 no longer align with the recesses 516 and controlling a lock 530 to limit the rotation of the removable farebox. The lock 530 need not mate with the removable farebox, but may only be configured to limit its rotation. In other embodiments, the lock 530 may mate with a portion of the removable farebox.

FIG. 5B is a side view of the removable farebox coupled to the mounting plate 510. The mounting plate 510 can be formed from two separate component plates. A lower plate 514 can be bolted or other wise secured to a mounting location using any method of fastening. For example, one or more bolts 524 can fasten the lower plate to the mounting location.

The lower plate 514 can also be fastened to the upper plate 512, and can be fastened in such a manner that precludes or resists removal of the upper plate 512 from the lower plate 514 when the lower plate is fastened to the mounting location. For example, one or more bolts 522 can extend from the underside of the lower plate 514 to corresponding threaded holes in the upper plate 512 to fasten the two plates 512 and 514 together. The mounting plate 510 can then be fastened to the mounting location using the bolts 524 that extend though the opening in the upper plate 512 that is used to receive the removable farebox. The lock 530 can be secured to the upper plate 512. In such a configuration, the mounting plate fasteners are not accessible when the farebox is secured within the mounting plate 510.

Figure 6:
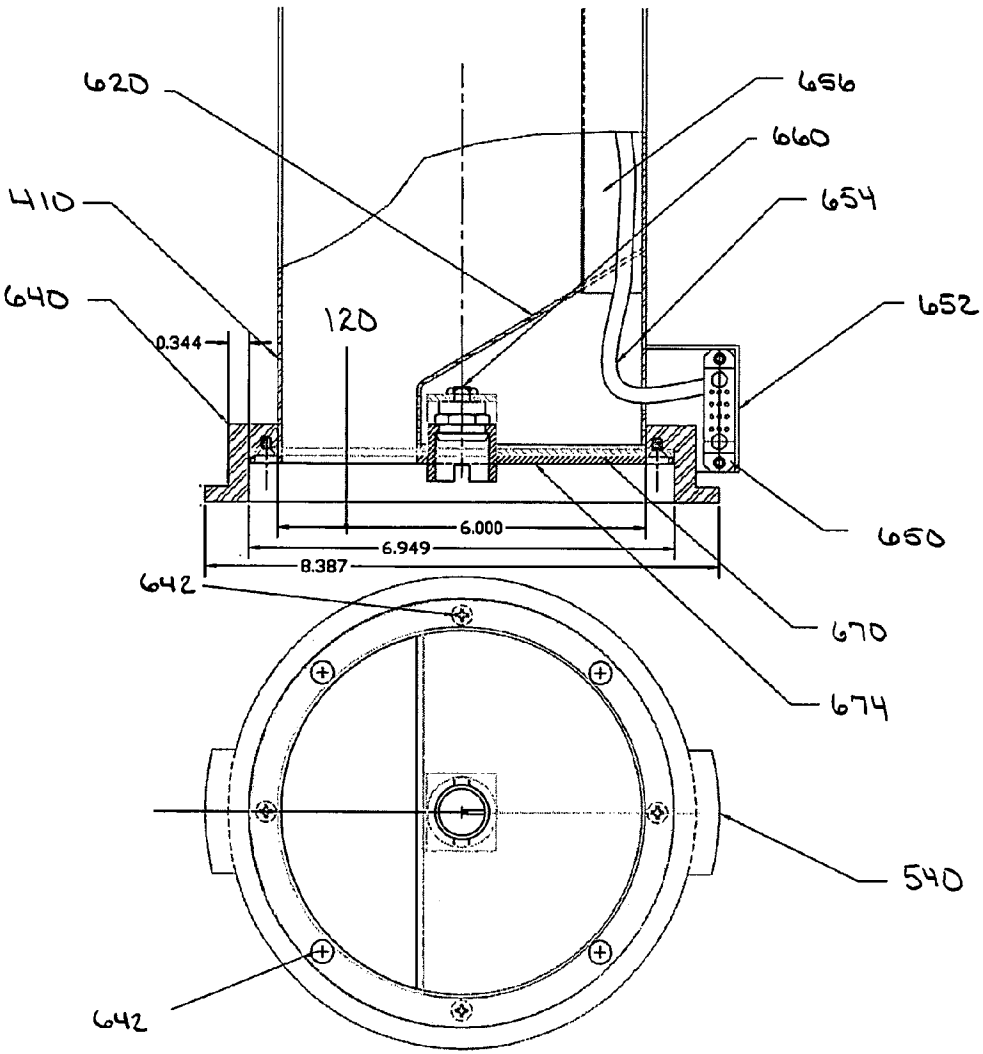
FIG. 6 is an embodiment of a mounting pedestal for a removable farebox.

FIG. 6 is an embodiment of a mounting pedestal for a removable farebox. The removable farebox housing 410 includes a base plate 640 positioned substantially at its lower end. The base plate 640 can include the one or more tangs 540 that extend from the base plate 640. One or more bolts 642 or some other manner of fastening can be used to fasten the base plate 640 to the housing 410.

Coins or tokens that are stored in the collection receptacle 120 can be emptied through a secure access that includes a shutter assembly 674 mounted to a lock frame 670 on the lower end of the removable farebox. In such a location, the secure access is not accessible when the removable farebox is inserted into the mounting plate. The position of the shutter assembly 674 can be changed using the lock 660. The contents of the collection receptacle 120 can be emptied by controlling the lock 660 to allow the shutter assembly 674 to rotate away from an opening. An end plate baffle 620 can be positioned within the collection receptacle 120 to direct the contents of the collection receptacle 120 towards the opening uncovered by the shutter assembly 674.

Because the secure access is positioned on the lower end of the removable farebox, it may be convenient to also locate the interface to the data port near the lower end of the farebox. Therefore, a power and communication interconnection 650 can be mounted on the lower portion of the removable farebox within a connector housing 652. An interconnect cable 654 or harness can extend within the housing 410 and can be routed to the appropriate electronics through a conduit 656 positioned within the housing 410. The conduit 656 can be used to isolate the interconnect cable 654 from the contents of the collection receptacle 120.

As described earlier, the removable farebox can be one part of a secure and auditable revenue collection system. The system can include a security cart that is configured to securely transport the removable fareboxes for installation in the fare collection points as well as transport the removable fareboxes from their fare collection points to a secure revenue collection location.

The security cart can be configured, for example, to securely transport removable fareboxes between the secure revenue collection location and a bus depot, when the removable fareboxes are installed in buses. The security cart can be configured as a mobile cart that secures removable fareboxes and provides continuous monitoring of the removable fareboxes as they move through a facility. The security cart can also provide a chain of custody of individual cash collecting devices as they are extracted from known locations and transported to other locations.

In the example revenue collection system where the removable fareboxes are installed in buses, empty fareboxes being returned to the bus depot from the revenue collection location can be installed in the security cart and can be removed from the cart at any time. Typically, removal occurs when a farebox is swapped with a farebox that has been used in revenue service.

The security cart can include an on-board processor that detects the inserted fareboxes and provides telemetry to a depot computer that updates which fareboxes are in place. The telemetry can be wired telemetry to a local computer coupled to the security cart or can be wireless telemetry transmitted to a remote computer. The security cart can be configured to communicate to the depot computer via a wired or wireless interface. A wireless interface allows telemetry, such as the location of fareboxes installed in the cart, to be monitored at all times.

The security cart can be used to used to transport empty removable fareboxes to the revenue collection locations. The security cart can be transported to various locations where empty fareboxes are removed from the cart and inserted into revenue collection points, such as on a bus. A removable farebox having revenue can be extracted from the revenue collection location and placed in the security cart.

Removable fareboxes containing revenue can be inserted in the security cart, and once installed, can be locked in place. The removable fareboxes having revenue can be removed from the cart using a security key typically restricted to the revenue collection location.

The processor in the security cart can detect the unique identity of the fare boxes and stores it internally. If configured, the processor sends via an on-board communications device, an updated status of the current contents of the security cart. In this way, an external monitoring computer can track the movement of empty and full fareboxes as they move about. This communications device can either be wired or wireless.

Figure 7:
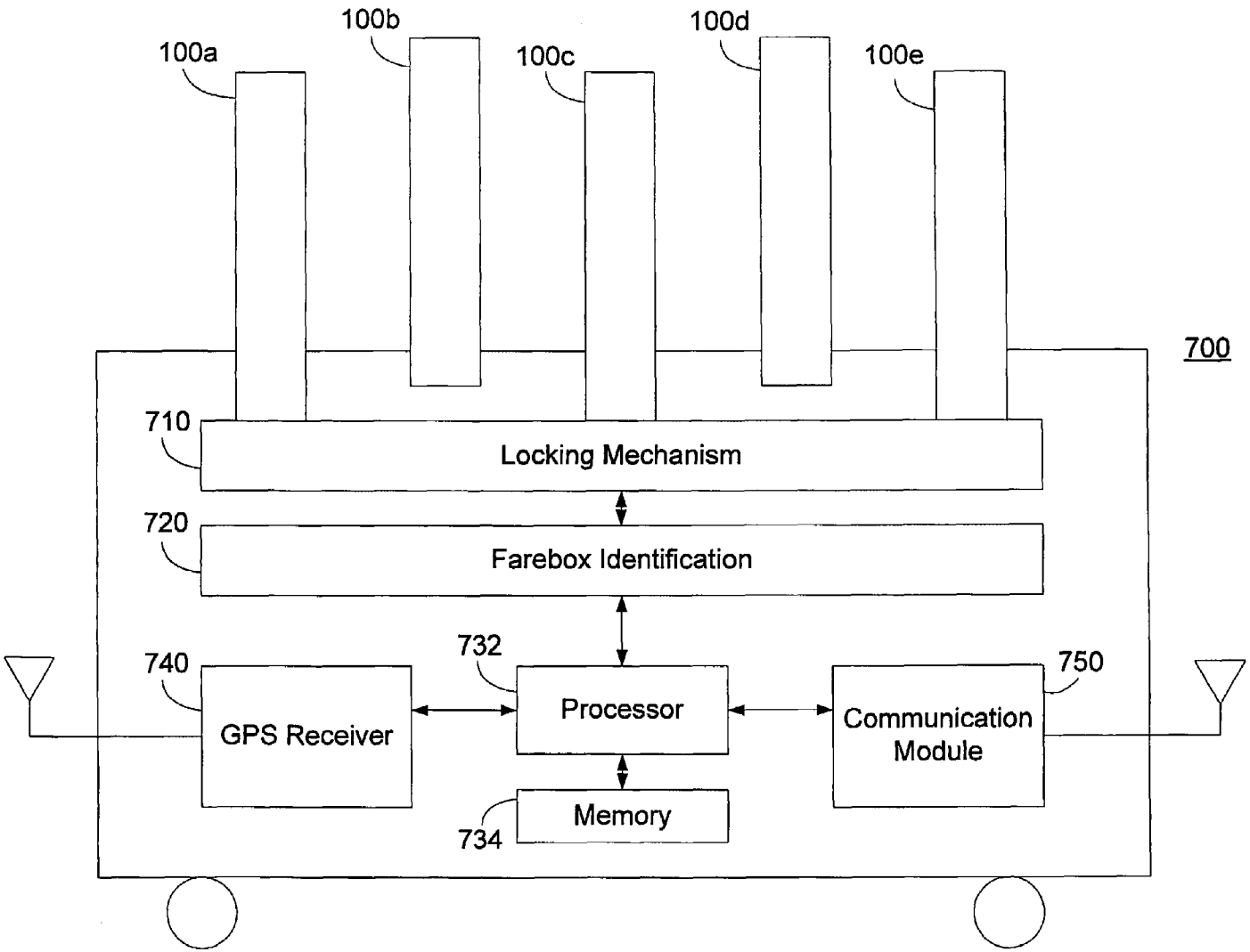
FIG. 7 is a functional block diagram of an embodiment of a removable farebox security cart.

FIG. 7 is a functional block diagram of an embodiment of a security cart 700. The security cart 700 can be a mobile container housing all subsystems. The security cart 700 can include storage compartments or receptacles configured to receive individual removable fareboxes 100*a*-100*e*. Although only five removable fareboxes 100*a*-100*e* are shown in FIG. 7, any number of removable fareboxes can be housed within the security cart 700 based on the dimensions of the cart and fareboxes.

The security cart 700 can include an identification detection module 720 configured to detect the unique identity of each of the removable fareboxes 100*a*-100*e* inserted in to the security cart 700. The identification detection module 720 can operate in conjunction with a processor 732 and memory 734 and can be configured to pass the identity information to the processor 732 for communication to another module. The identification detection module 720 can be configured to determine the removable farebox identification using a machine readable operation to eliminate potential errors associated with human data entry. The machine readable operation can be a wired or wireless operation and can be electronic or electromechanical. For example, the identification detection module 720 can be configured to read an RF tag located within each removable farebox 100*a*-100*e* to determine an associated serial number.

The identification detection module 720 can be coupled to a locking mechanism 710 that can be configured to selectively secures fareboxes containing cash and allow unrestricted removal of fareboxes that are empty. The identification detection module 720 can read telemetry or data stored in each of the removable fareboxes 100*a*-100*e* that indicates the expected amount of revenue collected by the box. If the identification detection module 720 determines that there is revenue in the removable farebox, the identification detection module 720 can indicate a lock command to the locking mechanism 710 to lock the removable farebox into the security cart 700. The removable farebox can then be locked in the security cart 700 until released using a key or code that can be restricted to the revenue collection location.

The processor 732 can operate in conjunction with one or more processor readable instructions stored in memory 734 to perform some or all of the functions of the other modules. The processor 732 can be coupled to an external communications module 750 configured to communicate with an external computer (not shown). The external computer can monitor the status of each farebox within one or more security carts 700. An optional GPS interface module 740 can be used to provide current geodetic location of the security cart 700. The processor 732 can receive the position location from the GPS interface module 740 and report it as telemetry to one or more external computers.

Figure 8:
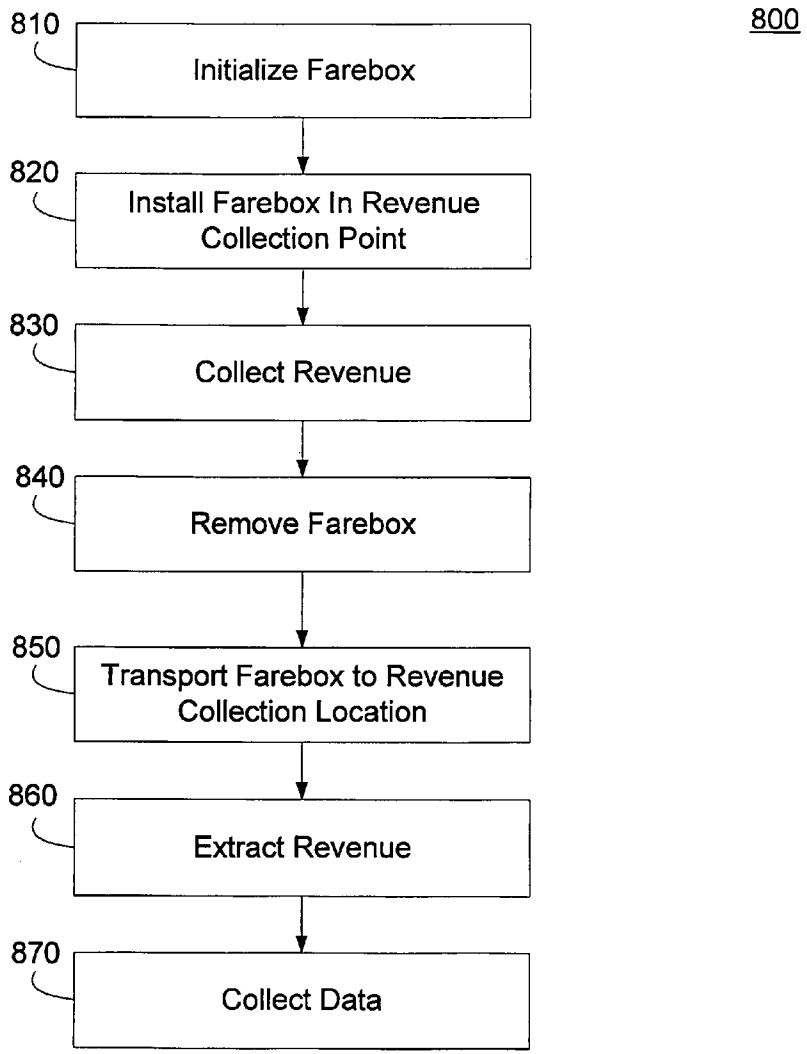
FIG. 8 is a flowchart of an embodiment of a method of revenue collection.

FIG. 8 is a flowchart of an embodiment of a method 800 of revenue collection. The method 800 can be performed by any revenue collection agency, for example, a transit system. The method 800 begins at block 810 when the revenue collection agency initializes the removable farebox. In one embodiment, the revenue collection agency may perform all operations on the removable fareboxes and can directly initialize the fareboxes. In other embodiments, the revenue collection agency can use another service for maintenance of the removable fareboxes and for servicing the actual revenue collection and reconciliation from the removable fareboxes. In such an embodiment, the revenue collection agency can indirectly initialize the removable fareboxes by sending them to the revenue extraction service and receiving empty removable fareboxes in return.

The revenue collection agency can then proceed to block 820 and install the empty removable fareboxes in the revenue collection points. The revenue collection points can be, for example, stationary locations such as those associated with a parking space, or mobile locations, such as on a bus or trolley.

The revenue collection agency then proceeds to block 830 and collects revenue using the removable fareboxes. Revenue collection can occur, for example, by putting a bus into service.

After collecting revenue, the revenue collection agency can proceed to block 840 and remove the removable fareboxes from the revenue collection points. For example, the revenue collection agency can remove the removable fareboxes from a bus following each shift change.

The revenue collection agency then proceeds to block 850 and transports the removable farebox to a revenue collection location. In one embodiment, the removable fareboxes are placed in a security cart for secure transport to a revenue collection location.

The revenue collection agency proceeds to block 860 and collects or other wise extracts the revenue from the removable fareboxes. The physical revenue can be extracted, for example, by emptying the contents of a revenue collection receptacle via a secure access. Other revenue can be extracted, for example, by downloading a value associated with electronic payments.

After extracting the revenue, the revenue collection agency can proceed to block 870 and retrieve the data that is collected by the removable farebox. The data can include, but are not limited to, the amount of revenue expected within the removable farebox, the number of each denomination received, and times for revenue receipt. After collecting the data, the revenue collection agency can return to block 810 to repeat the process for the next cycle.

Figure 9:
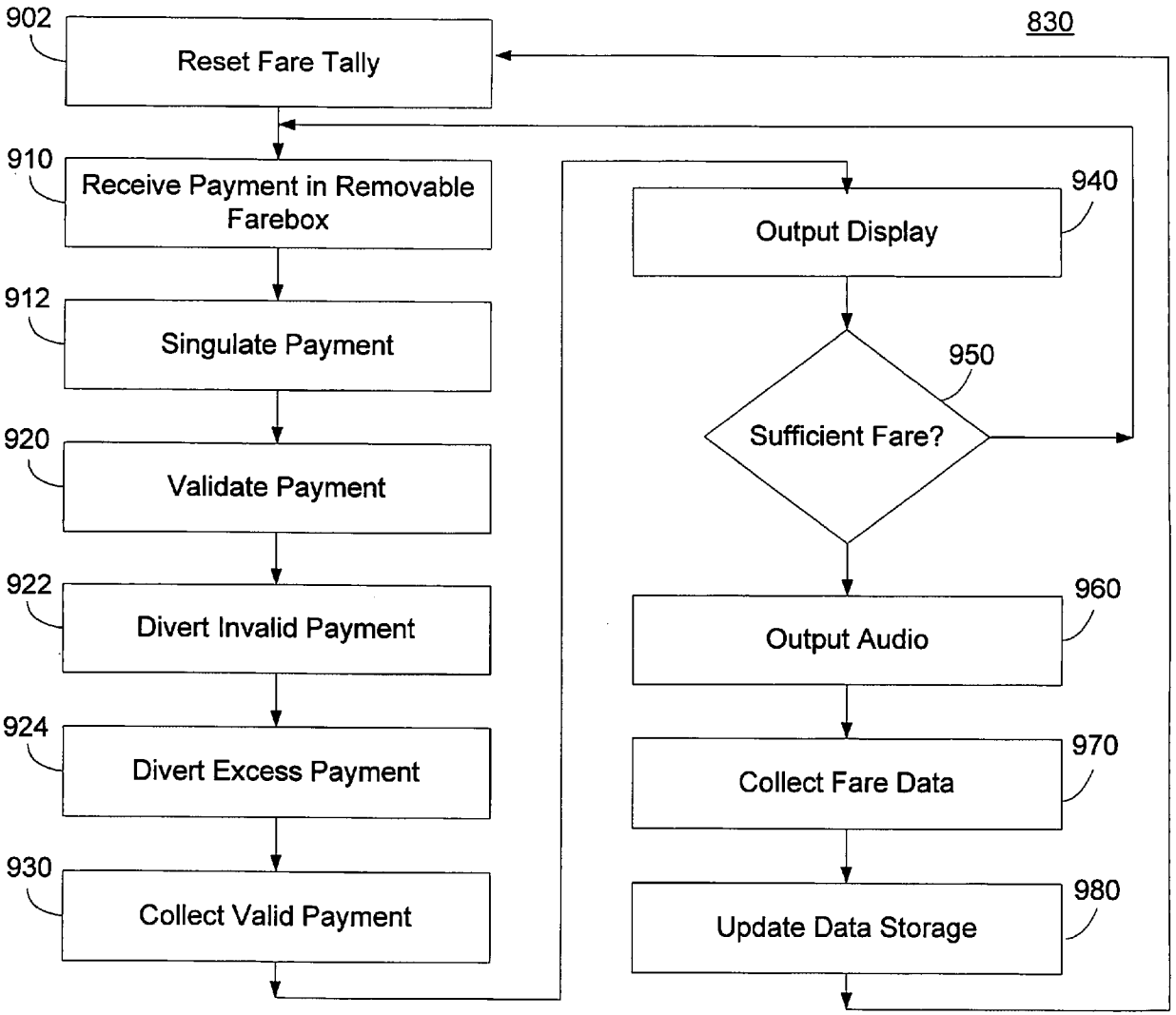
FIG. 9 is a flowchart of an embodiment of a method of revenue collection.

FIG. 9 is a flowchart of a method 830 of collecting revenue. The method 830 can be performed, for example, by one or more of the removable fareboxes disclosed herein. For example, the method 830 can be performed by the removable farebox of FIG. 1. Some or all of the steps or acts of the method 830 can be performed, for example, by a processor operating on one or more processor usable instructions stored in memory as software.

The method 830 begins at block 902 where the removable farebox resets or other wise initializes the running fare tally. The removable farebox then proceeds to block 910 and receives, in the removable farebox, a payment from a patron. The payment can be an electronic payment or a physical payment. Typically, the payment can be a physical payment in the form of one or more coins inserted into the removable farebox.

After receiving the payment the removable farebox can proceed to optional block 912 where the payment is singulated. The removable farebox can include, for example, a coin singulator configured to singulate multiple coins that are inserted substantially simultaneously.

After singulating the payment, the removable farebox proceeds to block 920 and validates the payment to determine if the payment is valid. The removable farebox then proceeds to optional block 922 where the invalid payments can be diverted using, for example, a diverter such as a coin diverter. The removable farebox can proceed to optional block 924 where excess payments can also be diverted using the coin diverter in conjunction with the validator.

After diverting invalid and excess payment, the removable farebox can proceed to block 930 to collect the payment in, for example, a collection receptacle that is integral to the removable farebox. After collecting the payment, the removable farebox proceeds to block 940 and outputs a display indication based on the received payment. The display output can include, for example, a running tally of the received fare and a value of the amount necessary for a full fare.

The removable farebox can proceed to decision block 950 and determine if a sufficient fare has been received. The removable farebox can compare an expected fare value against the running tally to determine if the sufficient fare has been received.

If the sufficient fare has not yet been received, the removable farebox proceeds from decision block 950 back to block 910 to receive additional payment. If instead, at decision block 950, the removable farebox determines that sufficient fare has been received, the removable farebox proceeds to block 960 and outputs audio indicating receipt of the sufficient fare.

The removable farebox can then proceed to block 970 to collect fare data, which can include the amount of the fare collected, the time the fare was collected, and the number and denominations making up the received fare. The removable farebox can then proceed to block 980 to update stored data to include the most recently collected data. The removable farebox can then return to block 902 to repeat the fare collection process.

A removable farebox, security cart for transport of the removable farebox, and methods for operating the removable farebox in a secure, auditable revenue collection system are disclosed. The removable farebox can be implemented as a validating farebox with an integral collection receptacle to reduce the costs of fare collection and to reduce the number and skill of manual actions that are required by legacy fareboxes.

The steps of a method, process, or algorithm described in connection with the embodiments disclosed herein may be embodied directly in hardware, in a software module executed by a processor, or in a combination of the two. The various steps or acts in a method or process may be performed in the order shown, or may be performed in another order. Additionally, one or more process or method steps may be omitted or one or more process or method steps may be added to the methods and processes. An additional step, block, or action may be added in the beginning, end, or intervening existing elements of the methods and processes.

The above description of the disclosed embodiments is provided to enable any person of ordinary skill in the art to make or use the disclosure. Various modifications to these embodiments will be readily apparent to those of ordinary skill in the art, and the generic principles defined herein may be applied to other embodiments without departing from the spirit or scope of the disclosure. Thus, the disclosure is not intended to be limited to the embodiments shown herein but is to be accorded the widest scope consistent with the principles and novel features disclosed herein.

What is claimed is:

1. An apparatus for revenue collection, the apparatus comprising:

a mounting apparatus configured to be installed at a revenue collection point;

a housing removably coupled with the mounting apparatus and configured to be removed from the mounting apparatus for revenue extraction;

a validator mechanically coupled to the housing and configured to validate a received payment;

a collection receptacle integral to the housing and configured to collect the received payment; and a secure access coupled to the housing and configured to provide access to contents of the collection receptacle only when the housing is removed from the mounting apparatus.

2. The apparatus of claim 1, further comprising a farebox controller coupled to the validator and configured to collect one or more data based on an output from the validator.

3. The apparatus of claim 2, wherein the one or more data comprises a running tally of revenue received.

4. The apparatus of claim 2, wherein the one or more data comprises a total revenue collected.

5. The apparatus of claim 2, wherein the one or more data comprises a time of revenue collection.

6. The apparatus of claim 2, further comprising at least one display coupled to the farebox controller and configured to display an output from the farebox controller generated based on at least one validator output.

7. The apparatus of claim 6, wherein the display is configured to display a running tally of received fares.

8. The apparatus of claim 2, further comprising a patron display coupled to the farebox controller and configured to display a running tally of revenue received from the patron.

9. The apparatus of claim 2, further comprising an audio output module coupled to the farebox controller and configured to emit an audio output in response to a signal from the farebox controller.

10. The apparatus of claim 9, wherein the audio output module is configured to emit an audible output when the farebox controller determines a received fare meets or exceeds an expected fare value.

11. The apparatus of claim 2, further comprising a data port coupled to the farebox controller and having one or more storage devices configured to store the one or more data collected by the farebox controller for subsequent extraction.

12. The apparatus of claim 1, further comprising a farebox identification module within the housing and configured to provide a unique machine readable identification.

13. The apparatus of claim 1, wherein the validator comprises an electronic coin validator having no movable mechanical parts.

14. The apparatus of claim 1, further comprising a diverter interposed between the validator and the collection receptacle and configured divert the received payment to one of a plurality of paths base on an output from the validator.

15. The apparatus of claim 1, further comprising a coin singulator having an input configured to receive a plurality of coins and having an output coupled to the validator.

16. The apparatus of claim 1, wherein the housing comprises a plurality of tangs configured to mate with and be captured by a mounting plate when the housing is installed in the revenue collection point.

17. The apparatus of claim 1, wherein the mounting apparatus comprises one of a mounting plat and a mounting pedestal.

18. An apparatus for revenue collection, the apparatus comprising:

a mounting apparatus configured to be installed at a revenue collection point;

a housing removably coupled with the mounting apparatus and configured to be removed from the mounting apparatus for revenue extraction;

a validator mechanically coupled to the housing and configured to validate a received payment;

a collection receptacle integral to the housing and configured to collect the received payment;

a secure access coupled to the housing and configured to provide access to contents of the collection receptacle only when the housing is not coupled with the mounting apparatus;

a farebox controller coupled to the validator and configured to generate an output based on an output from the validator and further configured to compile one or more data based on the output from the validator; and a data port coupled to the farebox controller and having one or more storage devices configured to receive the one or more data from the farebox controller for subsequent extraction.

19. The apparatus of claim 18, further comprising a coin diverter coupled to the validator and configured to route the received payment to a coin return mounted on the housing based on an output from the validator.

20. The apparatus of claim 18, further comprising a coin singulator having an input configured to receive a plurality of coins and having an output coupled to the validator.

21. The apparatus of claim 18, wherein the mounting apparatus comprises one of a mounting plat and a mounting pedestal.

22. An apparatus for revenue collection, the apparatus comprising:

a housing;

means for releasably securing the housing to a revenue collection point;

means for validating received revenue coupled to the housing;

means for providing an output based on an output from the means for validating;

means for collecting revenue received from the means for validating coupled to the housing; and means for securing the means for collecting revenue, the means for securing coupled to the housing such that the means for collecting revenue is accessible only when the housing is released from the means for releasbly securing.

23. The apparatus of claim 22, wherein the means for validating comprises an electronic coin validator.

24. The apparatus of claim 22, wherein the means for validating comprises an electro-mechanical coin validator.

25. The apparatus of claim 22, wherein the means for providing an output comprises a means for displaying an output.

26. The apparatus of claim 22, wherein the means for providing an output comprises a means for emitting an audio output displaying an output.

* * * * *

UNITED STATES PATENT AND TRADEMARK OFFICE

CERTIFICATE OF CORRECTION

PATENT NO. : 7,469,817 B2
APPLICATION NO. : 11/036203
DATED : December 30, 2008
INVENTOR(S) : Jeffrey S. Brumfield et al.

It is certified that error appears in the above-identified patent and that said Letters Patent is hereby corrected as shown below:

Column 16, Claim 22, line 52, delete “releasbly” and insert --releasably--

Column 16, Claim 26, line 63, after “output” delete “displaying an output”

Signed and Sealed this

Thirty-first Day of March, 2009

John Doll

JOHN DOLL
*Acting Director of the United States Patent and Trademark Office*